US006338218B1

(12) United States Patent
Hegler

(10) Patent No.: US 6,338,218 B1
(45) Date of Patent: Jan. 15, 2002

(54) APPARATUS FOR SUPPORTING A FIREARM

(76) Inventor: Sam J. Hegler, 401 Ten Mile Dr., DeSoto, TX (US) 75115

( * ) Notice: Subject to any disclaimer, the term of this patent is extended or adjusted under 35 U.S.C. 154(b) by 0 days.

(21) Appl. No.: 09/442,173

(22) Filed: Nov. 16, 1999

(51) Int. Cl.[7] ..... F41A 23/00
(52) U.S. Cl. ..... 42/94; 89/37.04
(58) Field of Search ..... 42/94; 89/37.04

(56) References Cited

U.S. PATENT DOCUMENTS 499,315 A * 6/1893 Borchardt
1,147,890 A * 7/1915 Purcell
1,890,423 A * 12/1932 Teagarden
2,403,654 A * 7/1946 Gerdes
2,582,140 A * 1/1952 Leek
3,016,802 A * 1/1962 Gruneberg
D203,680 S * 2/1966 Allison
4,007,554 A * 2/1977 Helmstadter
4,823,673 A * 4/1989 Downing
4,937,965 A * 7/1990 Narvaez
4,967,497 A * 11/1990 Yakscoe
5,070,636 A * 12/1991 Mueller
5,081,783 A * 1/1992 Jarvis
5,347,740 A * 9/1994 Rather et al.
5,666,757 A * 9/1997 Helmstadter
5,697,181 A * 12/1997 Savant
5,778,589 A * 7/1998 Teague
5,833,308 A * 11/1998 Strong, III et al.
5,913,667 A * 6/1999 Smilee
5,913,668 A * 6/1999 Messer
5,933,999 A * 8/1999 McClure et al.
5,974,719 A * 11/1999 Simonek
6,044,747 A * 4/2000 Felts

* cited by examiner

*Primary Examiner*—Michael J. Carone
*Assistant Examiner*—Troy Chambers
(74) *Attorney, Agent, or Firm*—Harry C. Post, III

(57) ABSTRACT

Apparatus for supporting a firearm in a shooting position. The apparatus has a base and a mounting member. A firearm support mechanism supports the firearm in a position above the mounting member. A connecting mechanism interconnects the mounting member and the base.

37 Claims, 4 Drawing Sheets

APPARATUS FOR SUPPORTING A FIREARM

BACKGROUND OF THE INVENTION

This invention relates to apparatus for supporting a firearm in a shooting position and, more particularly, to apparatus that allows a firearm to be moved while being supported by such apparatus.

In bench rest target shooting, rifle rests are used to support a rifle during the competition. An example of one of these rests has a base with three legs, the end of each leg resting on the upper surface of the bench. The fore end of the rifle is supported by a cradle that is connected by a screw mechanism to the base, while the rear end of the rifle is supported by a sandbag. Since the target and bench supporting the rifle rest are stationary, the shooter has ample time to adjust the rifle to the proper position for very accurate shooting.

Frequently, a rancher must shoot varmints to protect his livestock or property. Since the rancher and varmint are frequently separated by several hundred yards, the rancher is required to have a proper position for very accurate shooting. However, since the varmints may be very small and/or very mobile, the rancher does not have the time to make adjustments that are made during bench rest shooting competitions.

A device called the VARMINTER RIFLE REST has been sold by Outers of Omark Industries that apparently suggests a solution to this problem facing the rancher. This device has a Tee-shaped base with rubber feet at each end of the Tee for supporting in a horizontal plane. A rod extends upwardly from the Tee and a sleeve is movably connected to the rod. A screw is used to secure the sleeve to the rod that permits vertical adjustments. A first arm is connected to the sleeve and extends in a direction from the sleeve for pivotal movement in a plane substantially parallel to the plane formed by the Tee. Located above and below the connection of the first arm to the sleeve are upper and lower stub members. The stub members extend in a direction that is diametrically opposed to the direction in which the first arm extends. A second arm is pivotally connected to the upper stub member and a screw mechanism interconnects the lower stub member to the second arm for movement of the rifle perpendicular to the plane formed by the Tee. A firearm support device having a cradle portion and a rod portion is provided at each of the outboard ends of the first and second arms. The rifle is supported by two of these firearm support devices above the first and second arms. A screw is threaded through the arms at each of the outboard ends to secure the rod portions and therefore the cradle portions in the desired position. If desired, one of the firearm support devices can be removed from the end of one of the arms and a pistol butt mount used on that arm for positioning of a pistol.

BRIEF SUMMARY OF THE INVENTION

In accordance with the present invention, there is provided apparatus for supporting a firearm in a shooting position. The apparatus has a base and a mounting member. A firearm support mechanism supports the firearm in a position above the mounting member. A connecting mechanism pivotally interconnects the mounting member and the base.

Further, in accordance with the present invention, there is provided apparatus for supporting a firearm in a shooting position. The apparatus has a base and a mounting member. A connecting mechanism interconnects the mounting member and the base. A firearm support mechanism supports the firearm in a position above the mounting member. The firearm support mechanism has a cradle portion for supporting a portion of the firearm and apparatus urges the cradle portion away from the mounting member.

Further, in accordance with the present invention, there is provided apparatus for supporting a firearm in a shooting position. The apparatus has a base and a mounting member. A connecting mechanism pivotally interconnects the mounting member and the base. A firearm support mechanism supports the firearm in a position above the mounting member. The firearm support mechanism has a cradle portion for supporting a portion of the firearm and apparatus urges the cradle portion away from the mounting member.

BRIEF DESCRIPTION OF THE SEVERAL VIEWS OF THE DRAWING

Objects and advantages of the invention will become apparent upon reading the following detailed description and upon reference to the drawings, wherein like reference characters are used throughout to designate like parts.

DETAILED DESCRIPTION OF THE INVENTION

Figure 1:
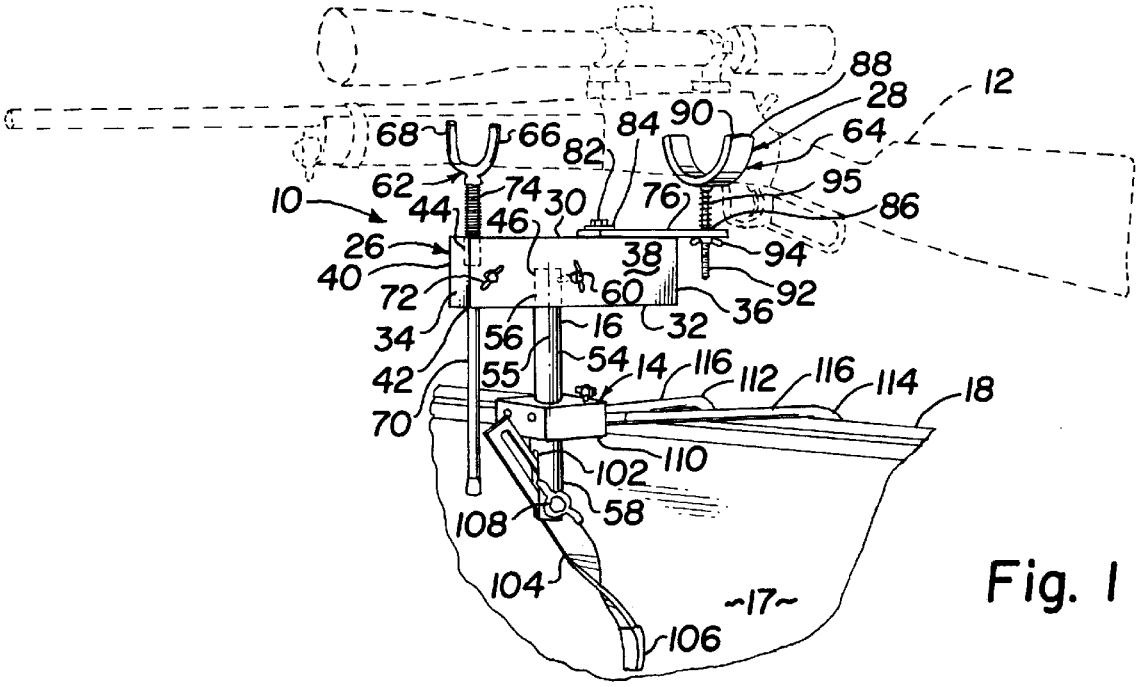
FIG. 1 is a perspective view, partly in section, from the front of apparatus constructed according to the present invention.
Figure 2:
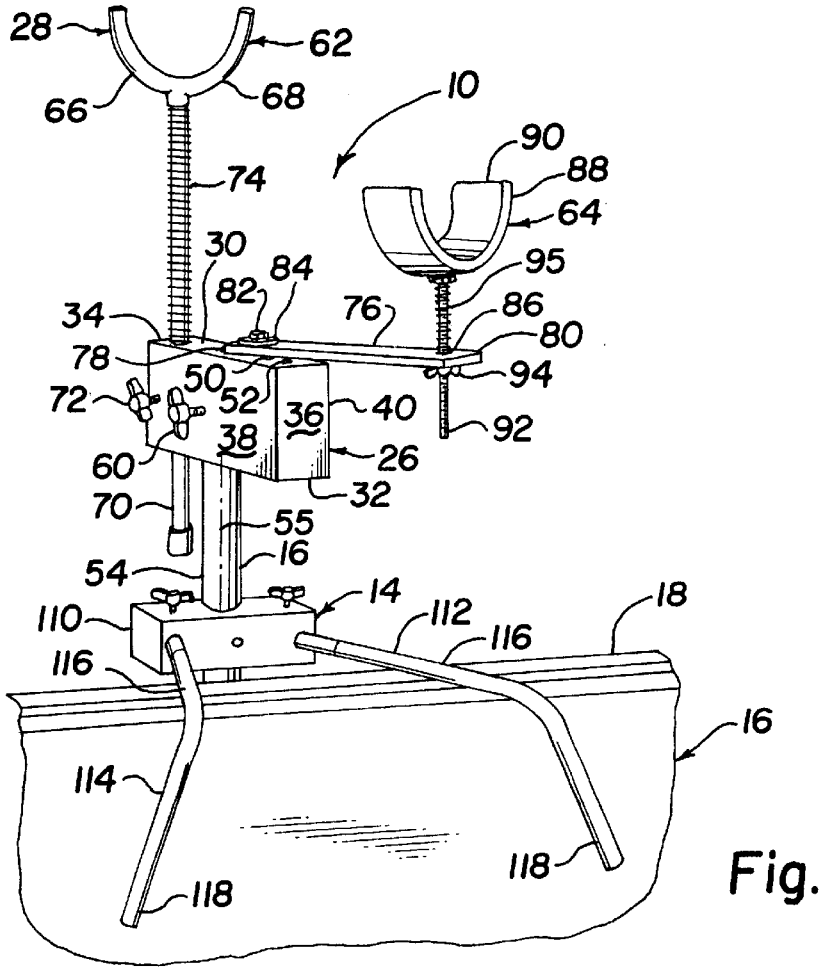
FIG. 2 is a perspective view from the rear of the apparatus shown in FIG. 1.
Figure 3:
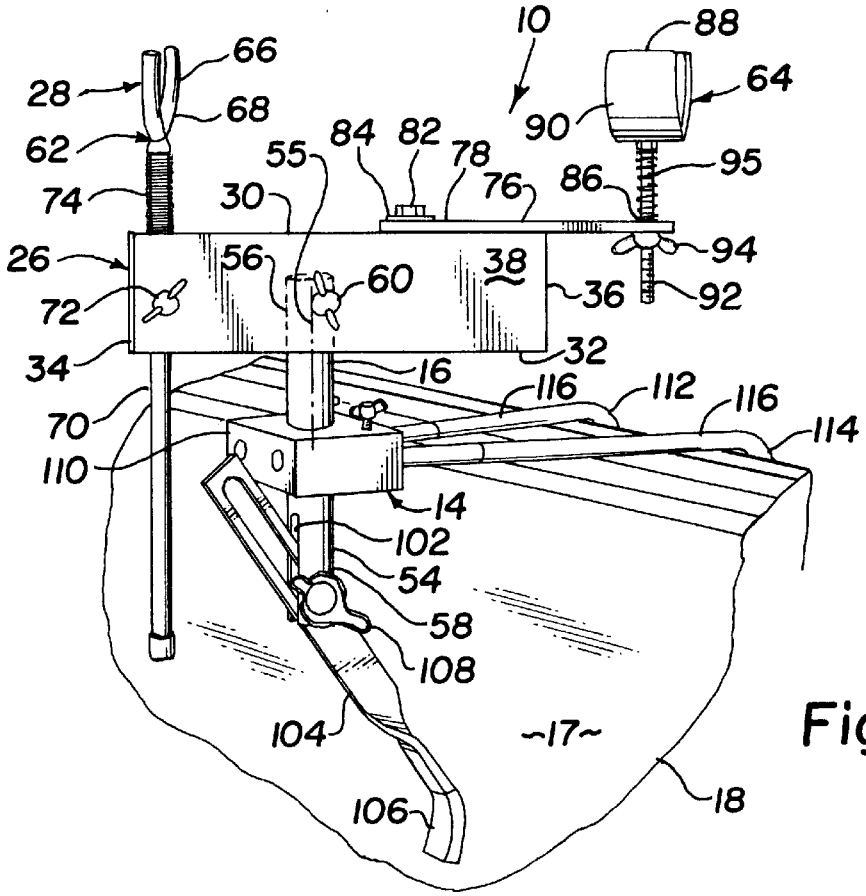
FIG. 3 is a perspective view, partly in section, from the side of the apparatus shown in FIG. 1.
Figure 4:
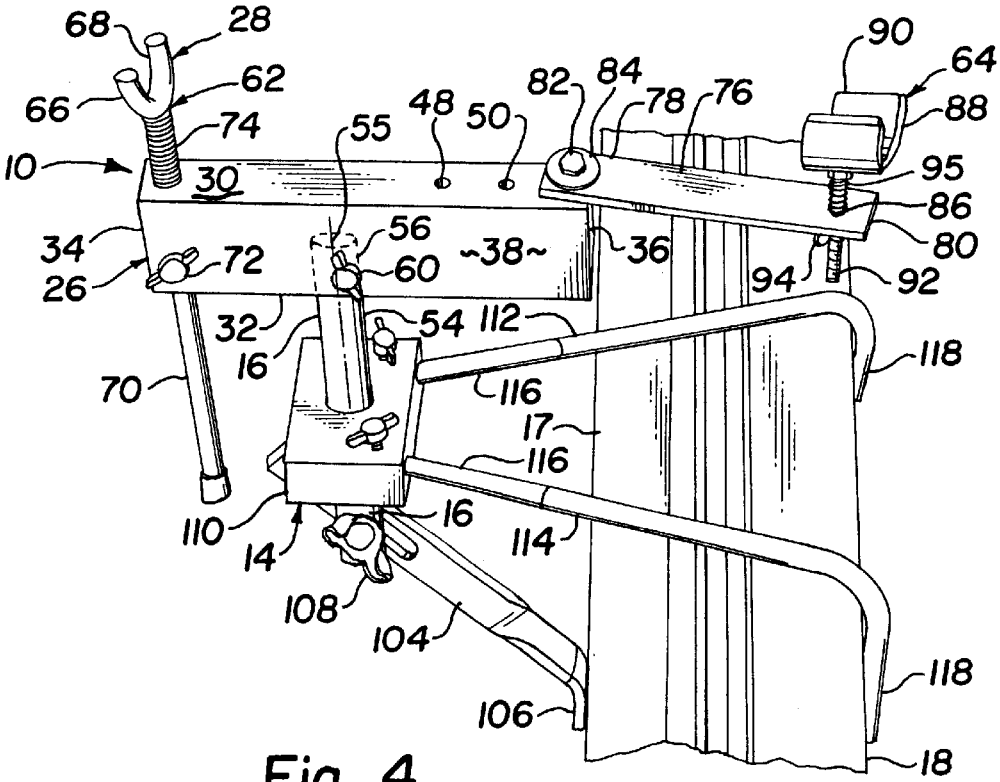
FIG. 4 is a perspective view, partly in section, from the top of the apparatus shown in FIG. 1.

Turning now to the drawing, there is shown an apparatus 10 for supporting a firearm 12 shown in dotted outline in a shooting position. Apparatus 10 includes a base 14 attached to a connecting mechanism 16 disposed in a position substantially vertical relative to the horizon while being fixed relative to base 14, which is supported on chosen support locations 17. Some examples of support locations 17 are provided on motor vehicles, such as trucks, automobiles, off-road vehicles or similar devices having a door or bed with a vertical sidewall; vertical building walls, such as those used in hunting blinds; or substantially flat surfaces such as those found on selected ground or rock areas. As best seen in FIGS. 1–5, base 14 is used on location 17 provided by a door 18 of a motor vehicle; in FIG. 6, base 14 is used on location 17 provided by a handle bar 20 used to steer a three or four wheeler off-road vehicle; in FIG. 7, base 14 is used on location 17 provided by a vertical wall 22 of a hunting blind or similar building; and in FIG. 8, base 14 is used on location 17 provided by a substantially horizontal surface 24 that is found in selected ground or rocky areas.

As best seen in FIGS. 1–4, apparatus 10 has a mounting member 26 for supporting a firearm support mechanism 28. It is preferred that mounting member 26 be an elongated rectilinear block of light weight metal, such as aluminum, that has a top 30, a bottom 32, a front 34, a back 36, a left side 38 and a right side 40. A front passageway 42 runs through the block from top 30 to bottom 32 near front 34 and midway between sides 38 and 40. Extending from top 30 is a counterbore 44 provided around passageway 42. Running upwardly from bottom 32 of member 26 is a support passageway 46 into which connecting mechanism 16 is received. Three threaded holes 48, 50 and 52 to permit adjustment extend from top 30 into member 26 substantially midway between left side 38 and right side 40 and in seriatim from passageway 46 to back 36.

Figure 7:
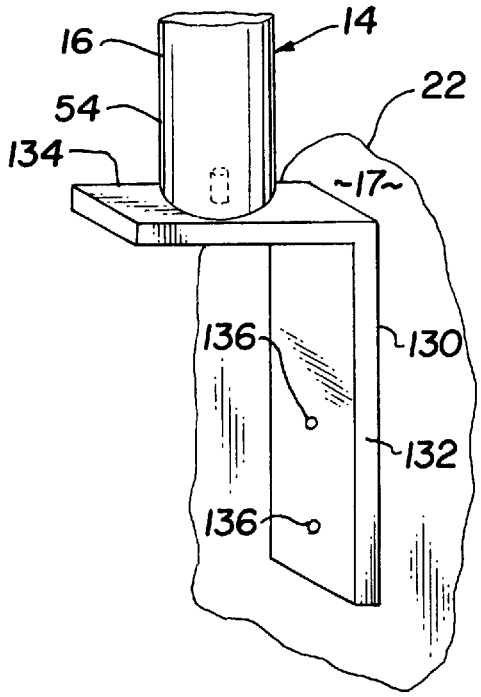
FIG. 7 is a perspective view from the top of a third modification of the apparatus shown in FIGS. 1 and 5.

Connecting mechanism 16 for pivotally interconnecting mounting member 26 and base 14 is made from a light weight metal, such as aluminum. Mechanism 16 has a body 54 in the shape of an elongated bar or rod with an elongate axis 55 and having an upper or first end 56 and a lower or second end 58. Body 54 has with a cross-sectional diameter sufficiently small to allow rotating movement within passageway 46 so that mounting member 26 may be pivotally moved around axis 55. If desired, a thumb screw 60 is connected to mounting member 26 for threaded engagement through left side 38 into passageway 46 to engage body 54 and prevent rotational movement of member 26 around elongate axis 55 of body 54 upon tightening. When desired, lower or second end 58 of body 54 is pivotally connected to base 14, as shown in FIG. 7. Thus, mounting member 26 is supported for pivotal movement around elongate axis 55.

Firearm support mechanism 28 is provided to support firearm 12 above mounting member 26 in a shooting position. The fore or barrel end of firearm 12 is supported by a fore end support mechanism 62 while the rear or butt end of firearm 12 is supported by a rear end support mechanism 64.

Fore end support mechanism 62 has a body 66 with a generally U-shaped cradle portion 68 to allow the fore end of firearm 12 to rest thereon and an elongated portion 70 that supports cradle portion 68 above mechanism 26. It is preferred that elongated portion 70 have a circular cross-section with a size sufficiently smaller that the size of passageway 42 to permit relatively unimpeded up and down movement of cradle portion 68 relative to mechanism 26. If desired, a thumb screw 72 is connected to mounting member 26 for threaded engagement through left side 38 into front passageway 42 to engage body elongated portion 70 and prevent the up or down movement of cradle portion 68 relative to mechanism 26 upon tightening. An urging device 74 is used to urge cradle portion 68 away from mounting member 26. It is preferred that a coil spring 74 disposed around elongated portion 70 be used as the urging device so that cradle portion 68 is continuously urged away from mounting member 26. The coil spring has a diameter sufficiently large to encircle elongated portion 70 and sufficiently small to be disposed within counterbored portion 44. Thus, the fore end of a rifle or pistol is supported by coil spring 74 so that the fore end of the rifle or pistol can be raised or lowered relative to mounting member 26 by proper application of a force applied against the butt of the rifle or pistol.

When a rifle is supported by rear end support mechanism 64 as shown in FIGS. 1–4, an extension member 76 is used. Extension member 76 has a first end 78 and a second end 80. Depending on the size of rifle 12, first end 78 is detachably connected at one of the adjustment locations 48, 50 and 52 in member 26 by use of a bolt 82 extending through a hole at first end 78 and washer 84 providing a bearing surface against member 76. Second end 80 has a passageway 86 provided therein. The rear end of rifle 12 is supported by a body 88, which has a generally U-shaped cradle portion 90 to allow the rear end of firearm 12 to rest thereon and an elongated portion 92 to support cradle portion 90 above mechanism 26. Elongated portion 92 has a circular cross-section with a size sufficiently smaller than the size of passageway 86 to permit relatively unimpeded up and down movement of cradle portion 90 relative to extension member 76. A thumb screw 94 connected by threads to extension member 76 may be used to secure the elongated portion 92 of body 88 in passageway 86 to extension member 76. An urging device 95 is used to urge cradle portion 90 away from extension member 76. It is preferred that urging device 95 is a coil spring disposed around elongated portion 92 be used as the urging device so that cradle portion 90 is continuously urged away from extension member 76. Coil spring 95 has a diameter sufficiently large to encircle elongated portion 92 and engage extension member 76.

Figure 5:
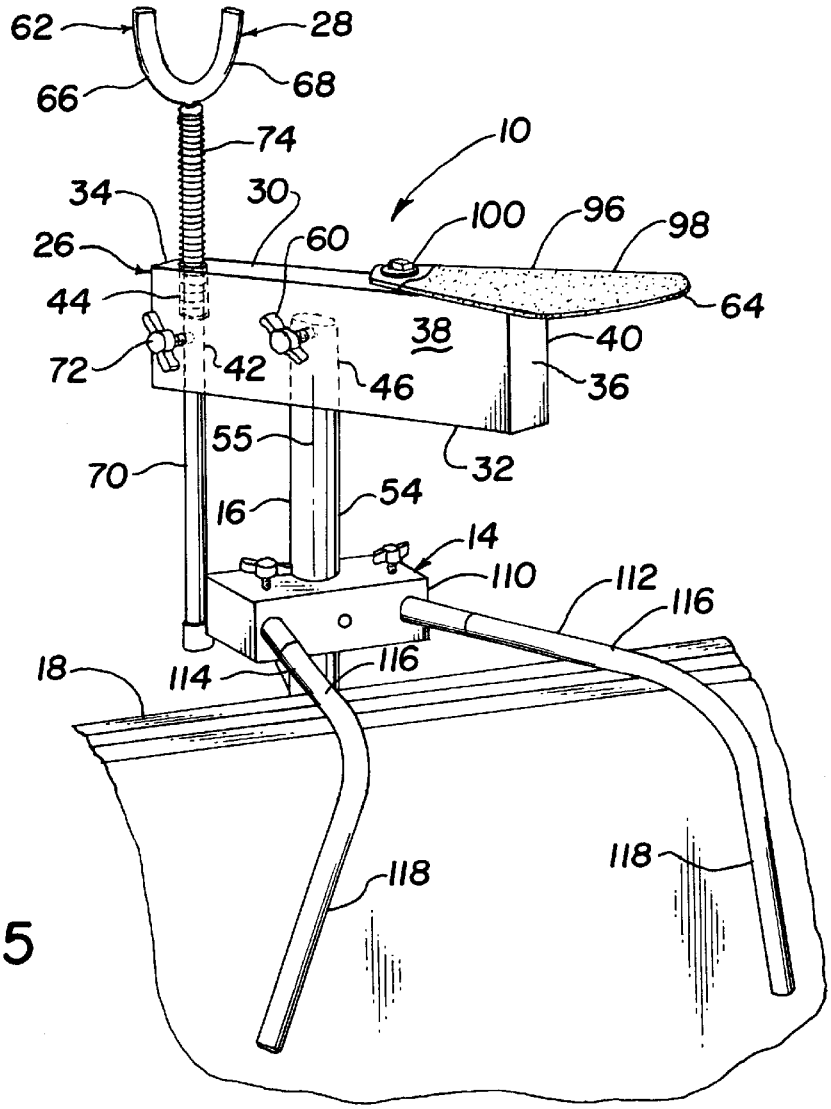
FIG. 5 is a perspective view, partly in section, from the rear of a first modification of the apparatus shown in FIGS. 1 and 5.

When firearm supporting apparatus 28 supports a pistol, fore end support mechanism 62 remains the same as shown in FIGS. 1–4 and as previously described in relation to these figures. However, rear end support mechanism 64 is different from that shown in FIGS. 1–4. As best seen in FIG. 5, a pistol rear end support mechanism 64 uses a modified extension member 96 having a relatively flat area 98 upon which the butt of the pistol rests and a hole 100 through which bolt 82 extends into one of the threaded holes 48, 50 or 52, and upon which washer 84 provides a bearing force. A stippling is provided on relatively flat area 98 to assist in preventing movement of the pistol butt relative to modified extension member 96.

When elongated body 54 is connected by base 14 to a motor vehicle, a slot 102 is provided in body 54. Slot 102 extends from second end 58, which is disposed below mounting member 26, toward first end 56. Base 14 has a support member 104 that is received in slot 102 of elongated connecting body 54. Support member 104 has an engaging portion 106 for engaging a surface at an angle. If desired, engaging portion 106 may be coated with a non-abrasive material. An attaching member 108, such as a thumb screw, secures support member 106 to connecting body 54 when elongated connecting body 54 is disposed in a substantially vertical position relative to the horizon. Included in base 14 are a mounting block 110 connected to elongated body 54 of connecting mechanism 16 and first and second rod members 112 and 114, respectively, connected to mounting block 110. Each rod member 112 or 114 has an extending portion 116 that extends substantially parallel to a plane formed by the horizon with a length sufficient to span a distance from elongated body 54 of connecting mechanism 16 to door 18 on a motor vehicle. A bent or ninety degree portion 118 of each rod member 112 or 114 extends from extending portion 116 in a direction transverse to extending portion 116 with a length sufficient to secure and support mounting block 110 to door 18. With extending portions 116 being an axis, the ends of each bent portion 118 is rotated around the axis to assist in making apparatus 10 stable.

Figure 6:
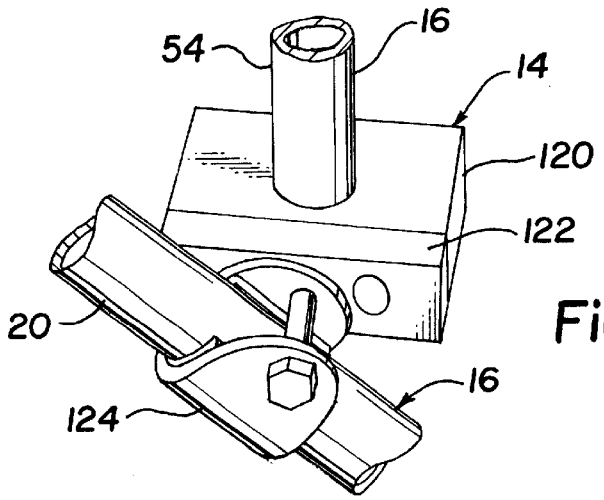
FIG. 6 is a perspective view from the top of a second modification of the apparatus shown in FIGS. 1 and 5.

As best seen in FIG. 6, when elongated body 54 is connected by base 14 to handle bar 20 of a three or four wheeler, base 14 has a first mounting block 120 connected to elongated body 54 of connecting mechanism 16. A second mounting block 122 is connected to first mounting block 120 and at least one U-shaped clamp 124 is connected to second mounting block 122. U-shaped clamp 124 has a size sufficient to extend substantially around a handlebar 20 used in steering the three or four wheeler off road vehicle.

As best seen in FIG. 7, when elongated body 54 of mechanism 16 is connected by base 14 to a vertical wall 17 provided on a hunting blind, base 14 has an inverted L-shaped member 130 with a vertical extension 132 and a horizontal extension 134. Vertical extension 132 has a plurality of passageways 136 for connection to wall 17 and horizontal extension 134 is substantially horizontally disposed when connected to wall 17. First end 56 of elongated body 54 is connected to mounting member 26 and second end 58 is pivotally connected in a conventional manner to horizontal extension 134 to allow rotational movement of firearm 12 around elongate axis 55 of body 54.

Figure 8:
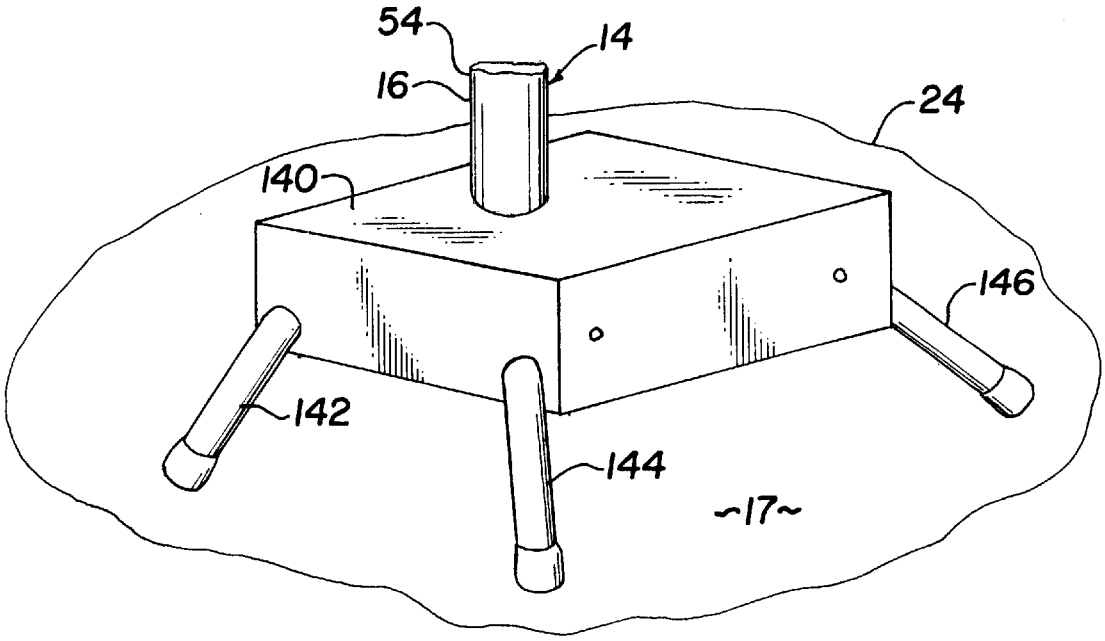
FIG. 8 is a perspective view from the top of a fourth modification of the apparatus shown in FIGS. 1 and 5.

As best seen in FIG. 8, when elongated body 54 of mechanism 16 is connected by base 14 to a flat support surface, a mounting block 140 is connected to mechanism 16. At least three legs 142, 144 and 146 are connected to mounting block 140 in a conventional manner to provide a stable position.

The invention having been described, what is claimed is:

1. Apparatus for supporting a firearm in a shooting position, comprising: a base; a mounting member; a firearm support mechanism for supporting the firearm in a position above and connected to said mounting member; and a connecting mechanism pivotally interconnecting said mounting member and said base to one another, said connecting mechanism including an elongated body having a slot extending from an end disposed below said mounting member, said base including a support member received in the slot of the connecting body, the support member having an engaging portion for engaging an angularly disposed support surface, and an attaching member for securing the support member to the connecting body when the elongated connecting body is disposed in a substantially vertical position relative to a horizon.

2. The apparatus set forth in claim 1, further comprising: said base including a mounting block connected to said connecting mechanism and first and second rod members connected to the mounting block, each rod member having an extending portion extending substantially parallel to a plane formed by the horizon with a length sufficient to span a distance from the elongated body of said connecting mechanism to a door on a motor vehicle and a bent portion extending from the extending portion in a direction transverse to the extending portion with a length sufficient to secure and support said mounting member to the door.

3. Apparatus for supporting a firearm in a shooting position, comprising: a base; a mounting member; a firearm support mechanism for supporting the firearm in a position above and connected to said mounting member; and a connecting mechanism pivotally interconnecting said mounting member and said base to one another, said base including an inverted L-shaped member having vertical and horizontal extensions, and the vertical extension having a plurality of passageways for connection to a wall, the horizontal extension being substantially horizontally disposed when connected to the wall; and said connecting member including first and second ends, the first end being connected to said mounting member and the second end being pivotally connected to the horizontal extension to allow rotational movement of the firearm relative to said mounting member.

4. Apparatus for supporting a firearm in a shooting position, comprising: a base; a mounting member; a connecting mechanism pivotally interconnecting said mounting member and said base to one another; and a firearm support mechanism for supporting the firearm in a position above and connected to said mounting member, said firearm support mechanism including a cradle portion for supporting a portion of the firearm and urging means for urging the cradle portion away from said mounting member.

5. The apparatus set forth in claim 4, further comprising: said firearm support mechanism including an elongated portion movably connected to said mounting member, and the urging means being a coil spring disposed around the elongated portion for continuously urging the cradle portion away from said mounting member.

6. The apparatus set forth in claim 5, further comprising: said firearm support mechanism including a fore end support mechanism disposed to support a fore end of the firearm and a rear end support mechanism disposed to support a rear end of the firearm.

7. The apparatus set forth in claim 6, further comprising: the fore end support mechanism including a cradle portion for supporting the fore end of the firearm and urging means for urging the cradle portion away from said mounting member.

8. The apparatus set forth in claim 7, further comprising: the fore end support mechanism including an elongated portion for supporting the cradle portion and the urging means being a coil spring disposed around the elongated portion for continuously urging the cradle portion away from said mounting member.

9. The apparatus set forth in claim 8, further comprising: said mounting member including a plurality of adjustment locations; and the rear end support mechanism including a firearm butt support member detachably connected at one of the adjustment locations of said mounting member.

10. The apparatus set forth in claim 6, further comprising: the rear end support mechanism including a cradle portion for supporting the rear end of the firearm and urging means for urging the cradle portion away from said mounting member.

11. The apparatus set forth in claim 10, further comprising: the rear end support mechanism including an elongated portion for supporting the cradle portion and the urging means being a coil spring disposed around the elongated portion for continuously urging the cradle portion away from said mounting member.

12. The apparatus set forth in claim 11, further comprising: said mounting member including a plurality of adjustment locations; and the rear end supporting mechanism including an extension member having one end detachably connected at one of the adjustment locations and another end connected to the elongated portion.

13. The apparatus set forth in claim 12, further comprising: the fore end support mechanism including a cradle portion for supporting the fore end of the firearm and urging means for urging the cradle portion away from said mounting member.

14. The apparatus set forth in claim 13, further comprising: the fore end support mechanism including an elongated portion for supporting the cradle portion and the urging means being a coil spring disposed around the elongated portion for continuously urging the cradle portion away from said mounting member.

15. The apparatus set forth in claim 4, further comprising: said connecting mechanism including an elongated body having a slot extending from an end disposed below said mounting member, said base including a support member received in the slot of the connecting body, the support member having an engaging portion for engaging an angularly disposed support surface, and an attaching member for securing the support member to the connecting body when the elongated connecting body is disposed in a substantially vertical position relative to a horizon.

16. The apparatus set forth in claim 15, further comprising: said base including a mounting block connected to said connecting mechanism and first and second rod members connected to the mounting block, each rod member having an extending portion extending substantially parallel to a plane formed by the horizon with a length sufficient to span a distance from the elongated body of said connecting mechanism to a door on a motor vehicle and a bent portion extending from the extending portion in a direction transverse to the extending portion with a length sufficient to secure and support said mounting member to the door.

17. The apparatus set forth in claim 4, further comprising: said base including a first mounting block connected to said connecting mechanism, a second mounting block connected to the first mounting block, and at least one U-shaped clamp connected to the second mounting block, the U-shaped clamp having a size sufficient to extend substantially around a handlebar used in steering an off road vehicle.

18. The apparatus set forth in claim 4, further comprising: said base including an inverted L-shaped member having vertical and horizontal extensions, and the vertical extension having a plurality of passageways for connection to a wall, the horizontal extension being substantially horizontally disposed when connected to the wall; and said connecting member including first and second ends, the first end being connected to said mounting member and the second end being pivotally connected to the horizontal extension to allow rotational movement of the firearm relative to said mounting member.

19. The apparatus set forth in claim 4, further comprising: a mounting block connected to said connecting mechanism and said base including at least three legs connected to the mounting block.

20. Apparatus for supporting a firearm in a shooting position, comprising: a base; a mounting member; a connecting mechanism pivotally interconnecting said mounting member and said base to one another; and a firearm support mechanism for supporting the firearm in a position above and connected to said mounting member, said firearm support mechanism including a cradle portion for supporting a portion of the firearm and urging means for urging the cradle portion away from said mounting member.

21. The apparatus set forth in claim 20, further comprising: said connecting mechanism including an elongated body having an end pivotally connected to said mounting member.

22. The apparatus set forth in claim 20, further comprising: said connecting mechanism including an elongated body having an end pivotally connected to said base.

23. The apparatus set forth in claim 20, further comprising: said firearm support mechanism including an elongated portion being movably connected to said mounting member, and the urging means being a coil spring disposed around the elongated portion for continuously urging the cradle portion away from said mounting member.

24. The apparatus set forth in claim 20, further comprising: said firearm support mechanism including a fore end support mechanism disposed to support a fore end of the firearm and a rear end support mechanism disposed to support a rear end of the firearm.

25. The apparatus set forth in claim 24, further comprising: the fore end support mechanism including a cradle portion for supporting the fore end of the firearm and urging means for urging the cradle portion away from said mounting member.

26. The apparatus set forth in claim 25, further comprising: the fore end support mechanism including an elongated portion for supporting the cradle portion and the urging means being a coil spring disposed around the elongated portion for continuously urging the cradle portion away from said mounting member.

27. The apparatus set forth in claim 24, further comprising: said mounting member including a plurality of adjustment locations; and the rear end support mechanism including a firearm butt support member detachably connected at one of the adjustment locations of said mounting member.

28. The apparatus set forth in claim 24, further comprising: the rear end support mechanism including a cradle portion for supporting the fore end of the firearm and urging means for urging the cradle portion away from said mounting member.

29. The apparatus set forth in claim 28, further comprising: the rear end support mechanism including an elongated portion for supporting the cradle portion and the urging means being a coil spring disposed around the elongated portion for continuously urging the cradle portion away from said mounting member.

30. The apparatus set forth in claim 29, further comprising: said mounting member including a plurality of adjustment locations; and the rear end supporting mechanism including an extension member having one end detachably connected at one of the adjustment locations and another end connected to the elongated portion.

31. The apparatus set forth in claim 30, further comprising: the fore end support mechanism including a cradle portion for supporting the fore end of the firearm and urging means for urging the cradle portion away from said mounting member.

32. The apparatus set forth in claim 31, further comprising: the fore end support mechanism including an elongated portion for supporting the cradle portion and the urging means being a coil spring disposed around the elongated portion for continuously urging the cradle portion away from said mounting member.

33. The apparatus set forth in claim 20, further comprising: said connecting mechanism including an elongated body having a slot extending from an end disposed below said mounting member, said base including a support member received in the slot of the connecting body, the support member having an engaging portion for engaging an angularly disposed support surface, and an attaching member for securing the support member to the connecting body when the elongated connecting body is disposed in a substantially vertical position relative to a horizon.

34. The apparatus set forth in claim 33, further comprising: said base including a mounting block connected to said connecting mechanism and first and second rod members connected to the mounting block, each rod member having an extending portion extending substantially parallel to a plane formed by the horizon with a length sufficient to span a distance from the elongated body of said connecting mechanism to a door on a motor vehicle and a bent portion extending from the extending portion in a direction transverse to the extending portion with a length sufficient to secure and support said mounting member to the door.

35. The apparatus set forth in claim 20, further comprising: said base including a first mounting block connected to said connecting mechanism, a second mounting block connected to the first mounting block, and at least one U-shaped clamp connected to the second mounting block, the U-shaped clamp having a size sufficient to extend substantially around a handlebar used in steering an off road vehicle.

36. The apparatus set forth in claim 20, further comprising: said base including an inverted L-shaped member having vertical and horizontal extensions, and the vertical extension having a plurality of passageways for connection to a wall, the horizontal extension being substantially horizontally disposed when connected to the wall; and said connecting member including first and second ends, the first end being connected to said mounting member and the second end being pivotally connected to the horizontal extension to allow rotational movement of the firearm relative to said mounting member.

37. The apparatus set forth in claim 20, further comprising: said base including a mounting block connected to said connecting mechanism and at least three legs connected to the mounting block.

* * * * *